US005349794A

United States Patent [19]

Taga

[11] Patent Number: 5,349,794

[45] Date of Patent: Sep. 27, 1994

[54] WALL FOR DAMPING VIBRATION

[75] Inventor: Masayasu Taga, Tokyo, Japan

[73] Assignee: Shimizu Construction Co., Ltd., Tokyo, Japan

[21] Appl. No.: 859,588

[22] Filed: Mar. 27, 1992

[51] Int. Cl.[5] ..... E04C 5/00

[52] U.S. Cl. ..... 52/167 CB; 52/167 RM

[58] Field of Search ..... 52/167 CB, 167 RM

[56] References Cited

FOREIGN PATENT DOCUMENTS

| | | | |
|---|---|---|---|
| 1-102182-A | 4/1989 | Japan . | |
| 0203571 | 8/1989 | Japan | 52/167 CB |
| 0125042 | 5/1990 | Japan | 52/167 CB |
| 0144435 | 6/1990 | Japan | 52/167 CB |
| 0209570 | 8/1990 | Japan | 52/167 CB |
| 0180675 | 8/1991 | Japan | 52/167 CB |
| 1-102183-A | 4/1993 | Japan . | |
| 1544902 | 2/1990 | U.S.S.R. | 52/167 CB |

*Primary Examiner*—Carl D. Friedman
*Assistant Examiner*—Wynn Wood
*Attorney, Agent, or Firm*—Darby & Darby

[57] ABSTRACT

A wall comprises at least one pair of connecting members, a plurality of bracings, a wall body, and unbonded layers. The connecting members are erected between a pair of beams, and connected to the beams. The connecting members are made of a low-strength steel. The bracings are made of a normal steel. One end of each of the bracings is attached to one of the connecting members and the other end of the bracing is attached to one of the beams. The wall body is made of precast concrete and surrounds the connecting members and the bracings. The wall body is disposed in a space between the beams. Unbonded layers are formed between the wall body and the connecting members so that the connecting members can slide relative to the wall body. However, the bracings are fixed in relation to the wall body.

11 Claims, 3 Drawing Sheets

WALL FOR DAMPING VIBRATION

BACKGROUND OF THE INVENTION

The present invention relates to a wall for damping vibrations or oscillations, which can absorb oscillation energy form, for example, earthquakes.

Recently, the study of earthquakes is advanced and the behavior of earthquakes is better understood. In this circumstance, various walls for damping oscillation and vibration are being developed.

In an example of such walls, a wall member made of precast concrete is connected between a pair of beams through connecting members of normal steel. Bracings of high-strength steel are disposed within the wall member. One end of each of the bracings is attached to one of the beams, and the other end is attached to the connecting members. The connecting members are disposed within the wall member, however, and an unbonded layer is formed between the connecting members and the wall member.

With this structure, the connecting members can move slightly with respect to the wall member, thereby reducing oscillation energy.

However, in this structure, the energy absorption ability is not sufficient to cope with the energy of large-scale earthquakes.

SUMMARY OF THE INVENTION

It is therefore an object of the present invention to provide a wall for damping oscillation or vibration energy even in the event of a large-scale earthquake.

In one aspect of the present invention, a wall comprises at least one connecting member, a plurality of bracings, a wall body, and unbonded layers. The connecting member is erected between a pair of beams, and connected to the beams. The connecting member is made of a low-strength steel. The bracings are made of a normal steel. One end of each of the bracings is attached to the connecting member, and the other end of the bracing is attached to one of the beams. The wall body is made of precast concrete and surrounds the connecting member and the bracings. The wall body is disposed in a space between the beams. The unbonded layers are formed between the wall body and the connecting member so that the connecting member can slide relative to the wall body.

With such a structure, since the connecting member is made of a low-strength steel, the connecting member can be plastically deformed when a large force is applied thereto. Accordingly, the energy of large-scale earthquakes can be concentrated to the connecting member while the other structural components are not affected by the earthquake energy. When a small force is applied to the wall, the connecting member slides relative to the wall body so that the energy is absorbed.

DESCRIPTION OF THE PREFERRED EMBODIMENT

With reference to the accompanying drawings, a preferred embodiment of the present invention will be described in detail.

Figure 1:
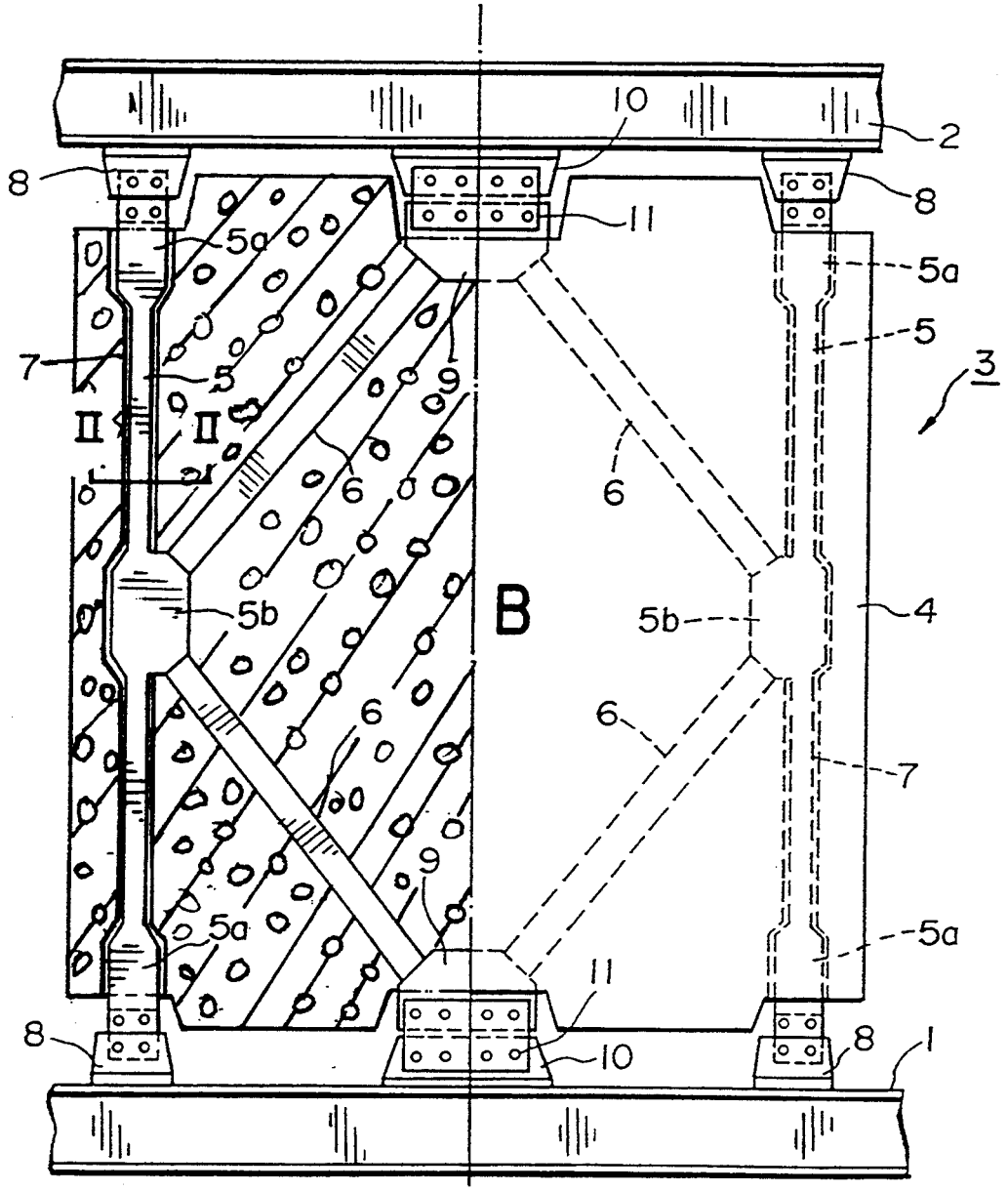
FIG. 1 is a front view of a wall according to the present invention, wherein the left part is a front cross section of the wall.

FIG. 1 depicts a wall for damping vibration or oscillation according to the present invention. The wall 3 is disposed between a lower beam 1 and an upper beam 2, which are disposed parallel to each other and are disposed horizontally in the same vertical plane. The beams 1 and 2 are made of steel wide-flange I-beams, and the flange portions thereof are disposed horizontally. The wall 3 of the present invention is disposed in the space defined by the beams 1 and 2. In order to support the wall 3, ribs 8 are mounted on the lower flange of the upper beam 2. Also, similar ribs 8 are mounted on the upper flange of the lower beam 1. On the intermediate portions between the ribs 8 on the beam 1 and 2, ribs 10 are mounted respectively.

The wall 3 comprises a wall body 4 made of a precast concrete. The wall body 4 is connected to the beams 1 and 2 through a pair of connecting members 5. Each of the connecting members 5 is made of a thin steel plate which is of a low mechanical strength. The connecting members 5 are erected vertically between the beams 1 and 2. Each of the end portions **5*a* of the connecting members 5 is mounted on the rib portions 8 by nuts and bolts. Each of the connecting members 5 includes the end portions 5*a* and the central portion 5*b* which are of a large width. Between the end portions 5*a* and the central portion 5*b*, the connecting members 5** have a smaller width.

The wall body 4 is also connected to the beams 1 and 2 through four bracings 6 of a normal steel. The bracing 6 is designed to have a higher mechanical strength than the connecting members 5. One end of each of the bracings 6 is mounted on the central portion **5*b* of the connecting members 5. The other end of the bracing 6 is mounted on a plate 9. The plate 9 is mounted on the rib 10 of the beam 1 or 2 through connecting plates 11 by nuts and bolts. Accordingly, the four bracings 6 cooperate to form a rhombic shape, in such a manner that the plates 9 and the central portions 5*b*** form the apexes of the rhombic shape.

Figure 2:
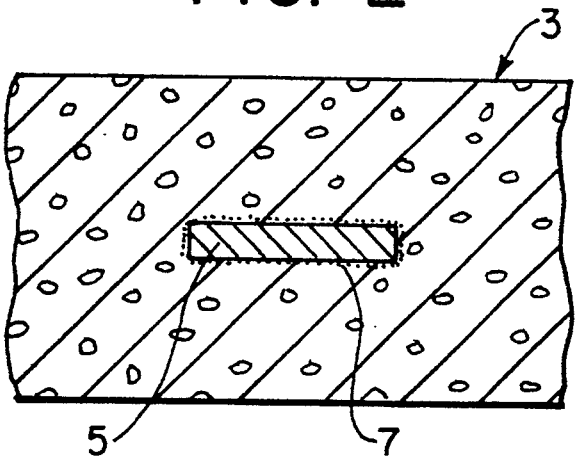
FIG. 2 is a cross-sectional view taken along the line II—II in FIG. 1.

The wall body 4, which is of a generally rectangular shape, surrounds the connecting members 5 and the bracings 6. Between the wall body 4 and the connecting members 5, unbonded layers 7 made of, for example, grease are formed. FIGS. 1 and 2 illustrate this construction. Therefore, the connecting members 5 can move slightly with respect to the wall body 4. On the other hand, the bracings 6 are fixed relative to the wall body 4 and there is no unbonded layer between them. On the corners of the wall body 4, notch portions are formed so as to accommodate the ribs 8. In addition, notch portions are formed so as to accommodate the ribs 10.

In the wall body 4, reinforcements are provided, however, the representation of the reinforcements is omitted. The arrangement and location of the reinforcements are optionally designed so that the required rigidity of the wall body 4 is satisfied.

The operation of the wall 3, when an outside force is applied, is described in the following.

When no outside force is applied to the wall 3, the wall 3 is in the static condition as shown in FIG. 1. The connecting members 5 are vertically oriented. The bracings 6 are maintained to form the rhombic shape.

For example, assume that a small scale horizontal force caused by winds or small earthquakes is applied to the wall 3, and thereby the upper beam 2 is horizontally moved with respect to the lower beam 1. Then, the wall 3 rotates generally about the center B thereof, the direction of rotation being dependent upon the direction of the initially applied horizontal force. At the same time, the outside force is transmitted to the connecting members 5 through the bracings 6.

As a result of this rotation, in each of the connecting members 5, in a portion on one side of the associated central portion 5*b*, a compression force along the lengthwise direction thereof is generated, and a tensile force along the lengthwise direction thereof is generated in the portion of the connecting member on the other side of the associated central portion 5*b*. The connecting members 5 are designed to have sufficient rigidity to endure small horizontal forces, that is, to have elastic deformation when small horizontal forces are applied. Therefore, the mechanical characteristics of the wall 3 are maintained while the small horizontal force is applied.

Furthermore, since the connecting members 5 are made of a low-strength steel, the connecting members 5 can be plastically deformed when a large scale horizontal force is applied to the wall 3. Accordingly, the energy from an earthquake can be concentrated in the connecting members, so that the other structural components are not affected by the earthquake energy.

That is, during the application of a small horizontal force, energy is absorbed by the movement of the connecting members 5 relative to the wall body 4 while the mechanical characteristics of the wall are maintained. For the large horizontal force, energy is absorbed by the deformation of the connecting members 5. The rigidity and the elastic characteristics of the wall are defined by those of the connecting members 5. Accordingly, these characteristics of the entire wall can be understood from the rigidity and the elastic characteristics of the connecting members 5. Furthermore, since these connecting members 5 are made of a low-strength steel, the variation in yielding points of the connecting members 5 is small. Therefore, the rigidity and the elastic region of the wall (and thus the absorption energy) can be realized accurately.

Figure 3:
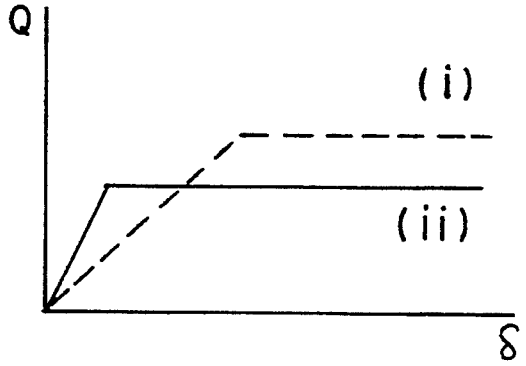
FIG. 3 is a graph showing the relationship between shearing force and deformation of the wall according to the present invention, and that of a comparison example.
Figure 4:
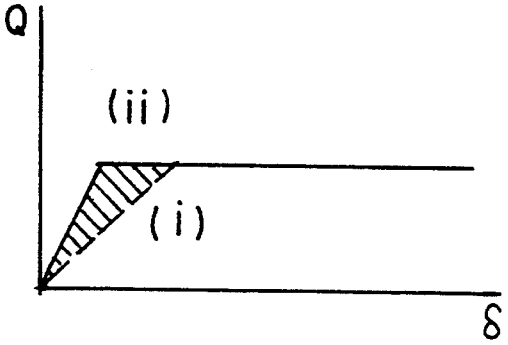
FIG. 4 is a graph showing the relationship between shearing force and deformation of another wall according to the present invention, and that of a comparison example.

With reference FIGS. 3 and 4, the relationship between shearing force Q and deformation $\delta$ of the wall according to the present invention (ii), and that of a comparison example (i), are compared.

With regard to FIG. 3, the dimensions of the components in the wall of the comparison example (i) are the same as those of the wall of the present invention (ii). In the comparison example, the connecting members 5 are made of a normal steel. From FIG. 3, it is understood that the mechanical strength of the wall of the present invention (ii) is smaller than that of the wall of the comparison example (i). The elasticity of the wall of the present invention (ii) is larger than that of the wall of the comparison example (i). It is understood that in the wall of the present invention (ii), since the connecting members 5 yield easily, large earthquake energy may be absorbed.

With regard to FIG. 4, the connecting members are made of a normal steel in comparison example (i). The connecting members of the present invention (ii) and the comparison example (i) are designed to withstand the same load. That is, the cross section of the connecting members of the present invention (ii) is larger than that of the comparison example (i). The dimensions of the other components in the wall of the comparison example (i) are the same as those of the wall of the present invention (ii). From FIG. 4, it is understood that the wall of the present invention (ii) withstands the same load as the wall of the comparison example (i). However, the elasticity of the wall of the present invention (ii) is larger than that of the wall of the comparison example (i). It is understood that in the wall of the present invention (ii), since the connecting members 5 yield during the application of a small deformation, large earthquake energy may be absorbed.

If the wall of the present invention is used in a multistoried building, it is preferred that the wall of the first floor be produced by the present invention, and the walls of the second floors or above be produced conventionally. In this structure, the energy of an earthquake may be concentrated to only the first floor while the mechanical characteristics of the other stories are maintained. Since only the first floor is produced by the present invention, other stories can be produced conventionally. Thus, the cost performance is enhanced.

The low-strength steel used for the connecting members 5, namely the extremely soft steel, preferably has the following characteristics:

Yielding Point: preferably below 15 kgf/mm$^2$ about 10 kgf/mm$^2$ (in the embodiment)
Tensile Strength: about 28 kgf/mm$^2$
Elongation: about 70%.

On the other hand, the normal steel used for the bracings 6 is, for example, SS41 or SM50A in accordance with Japanese Industrial Standard.

SS41 has the following characteristics:
Yielding Point: about 24 kgf/mm$^2$
Tensile Strength: about 41 kgf/mm$^2$
Elongation: more than 17 to 20%.
(Elongation depends on the thickness and configuration of the material.)

SM50A has the following characteristics:
Yielding Point: about 33 kgf/mm$^2$
Tensile Strength: about 50 kgf/mm$^2$
Elongation: more than 18 to 23%.
(Elongation depends on the thickness and configuration of the material.)

It is apparent from the above data that the mechanical strength of the low-strength steel in the present invention is preferably about half of that of the normal steel.

Figure 5:
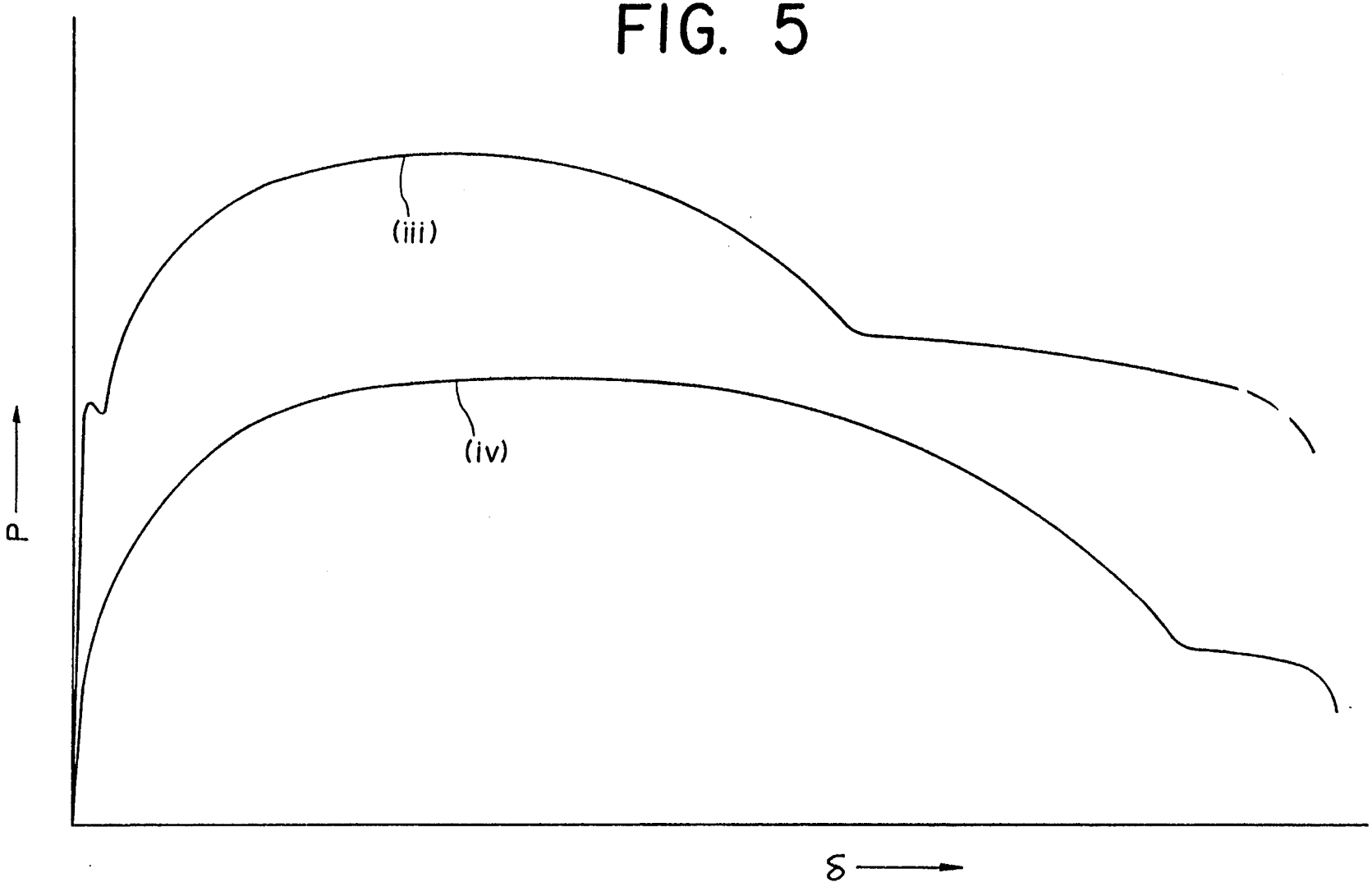
FIG. 5 is a graph showing tensile force versus deformation for comparing a low-strength steel according to the present invention and a normal steel.

FIG. 5 is a graph showing tensile force versus deformation, comparing a low-strength steel (iv) according to the present invention and a normal steel (iii). In the graph, as usual, the ordinate designates tensile force P applied to the steels, and the abscissa designates deformation $\delta$ of the steels. The normal steel (iii) as is well known, has a yielding term which is clearly shown in the graph. In contrast, the low-strength steel (iv) does not have a clearly shown yielding term.

While in the above description, a preferred embodiment of the present invention is explained, it is not intended to limit the present invention to the above embodiment. Other variations and modifications can be designed without violating the spirit and objects of the present invention.

In the above embodiment, a pair of connecting members 5 is employed within the wall body 4. However, at least one connecting member is necessary.

In the above embodiment, the connecting members 5 and the bracings 6 are connected to the beams 1 and 2 by nuts and bolts. However, welding may be used to connect the beams instead of the nuts and bolts.

What is claimed is:

1. A wall for damping vibration and oscillation, comprising:

at least one connecting member erected between a pair of beams, and connected to the beams, the connecting member being made of a first strength steel;

a plurality of bracings made of a second strength steel, one end of each of the bracings being attached to the connecting member, the other end of the bracing being attached to one of the beams; said second strength steel having a higher yield point and tensile strength than said first strength steel;

a wall body made of precast concrete surrounding the connecting member and the bracings, said bracings being fixed relative to the wall body, and the wall body being disposed in a space between the beams; and unbonded layers formed between the wall body and the connecting member so that the connecting member can slide relative to the wall body.

2. The wall according to claim 1, wherein said first strength steel has a mechanical strength approximately half that of the second strength steel.

3. The wall according to claim 2 wherein said first strength steel has a yielding point below 15 kgf/mm$^2$.

4. A wall for damping vibration and oscillation, said wall being supported between a pair of beams having a space therebetween comprising:

at least one connecting member erected between said pair of beams, and connected to the beams, the connecting member being made of a first steel;

a plurality of elongated bracings made of a second steel, one end of each of the bracings being attached to said connecting member, the other end of each said bracing being attached to a respective one of the beams, said first steel having a lower mechanical strength than said second steel;

a wall body made of concrete surrounding the connecting member and the bracings, the wall body being disposed in said space between the beams, said bracings being fixed relative to said wall body; and an unbonded layer formed between the wall body and the at least one connecting member, said layer permitting the connecting member to slide relative to the wall body when said wall is subjected to external force.

5. A wall according to claim 4, wherein said first steel has a mechanical strength approximately half that of said second steel.

6. A wall according to claim 5, wherein said first steel has a yielding point below 15 kgf/mm$^2$.

7. A wall according to claim 4, wherein the number of said connecting members is at least two, each said connecting member having a respective pair of said bracings attached thereto, said bracings being positioned substantially as a rhomboid.

8. A wall according to claim 4, wherein said concrete is precast.

9. A wall according to claim 4, wherein said unbonded layer is grease.

10. A wall as in claim 1, wherein, under increased load, said connecting members are subject to permanent deformation before said bracings reach their elastic limit.

11. A wall as in claim 4, wherein, under increased load, said connecting members are subject to permanent deformation before said bracings reach their elastic limit.

* * * * *